US009258661B2

(12) United States Patent
Zheng et al.

(10) Patent No.: US 9,258,661 B2
(45) Date of Patent: Feb. 9, 2016

(54) AUTOMATED GAIN MATCHING FOR MULTIPLE MICROPHONES

(71) Applicant: QUALCOMM Incorporated, San Diego, CA (US)

(72) Inventors: Jimeng Zheng, San Diego, CA (US); Ian Ernan Liu, San Diego, CA (US); Dinesh Ramakrishnan, San Diego, CA (US); Deepak Kumar Challa, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 147 days.

(21) Appl. No.: 14/139,370

(22) Filed: Dec. 23, 2013

(65) Prior Publication Data

US 2014/0341380 A1 Nov. 20, 2014

Related U.S. Application Data

(60) Provisional application No. 61/824,222, filed on May 16, 2013.

(51) Int. Cl.

| | |
|---|---|
| ***H04R 29/00*** | (2006.01) |
| *H04R 3/00* | (2006.01) |
| *G10L 25/84* | (2013.01) |

(52) U.S. Cl.

CPC ..... *H04R 29/006* (2013.01); *G10L 25/84* (2013.01); *H04R 3/005* (2013.01)

(58) Field of Classification Search

None

See application file for complete search history.

(56) References Cited

U.S. PATENT DOCUMENTS

| | | | | |
|---|---|---|---|---|
| 7,171,008 | B2 | 1/2007 | Elko | |
| 7,716,044 | B2 | 5/2010 | Kobayashi et al. | |
| 8,098,844 | B2 | 1/2012 | Elko | |
| 8,229,126 | B2 | 7/2012 | Chamberlain et al. | |
| 2004/0049380 | A1* | 3/2004 | Ehara et al. | 704/219 |
| 2006/0147054 | A1* | 7/2006 | Buck et al. | 381/92 |
| 2009/0136057 | A1 | 5/2009 | Taenzer | |
| 2009/0316731 | A1* | 12/2009 | Kong | 370/544 |
| 2011/0051953 | A1* | 3/2011 | Makinen et al. | 381/92 |
| 2011/0075859 | A1* | 3/2011 | Kim et al. | 381/92 |
| 2011/0313763 | A1 | 12/2011 | Amada | |
| 2013/0272540 | A1 | 10/2013 | Aahgren et al. | |

FOREIGN PATENT DOCUMENTS

| | | | |
|---|---|---|---|
| EP | 2466581 | A2 | 6/2012 |
| WO | 2009130388 | A1 | 10/2009 |

OTHER PUBLICATIONS

International Search Report and Written Opinion for International Application No. PCT/US2014/036634, ISA/EPO, Date of Mailing Jul. 30, 2014, 11 pages.

* cited by examiner

*Primary Examiner* — Brenda Bernardi

(74) *Attorney, Agent, or Firm* — Toler Law Group, PC

(57) ABSTRACT

A method includes receiving, at a processor, a first data frame at a first time from a first microphone. The method also includes receiving a second data frame at the first time from a second microphone. The method further includes calculating a power ratio of the first microphone and the second microphone based on the first data frame and the second data frame in response to determining that the first data frame and the second data frame are noise data frames.

30 Claims, 11 Drawing Sheets

AUTOMATED GAIN MATCHING FOR MULTIPLE MICROPHONES

I. CLAIM OF PRIORITY

The present application claims priority from U.S. Provisional Patent Application No. 61/824,222, filed May 16, 2013, entitled "AUTOMATED GAIN MATCHING FOR MULTIPLE MICROPHONES," the contents of which are incorporated by reference in their entirety.

II. FIELD

The present disclosure is generally related to automated gain matching for multiple microphones.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

Audio processing systems in wireless telephones may use multiple-microphone systems that increase audio quality based on multi-channel digital processing algorithms. For example, in comparison to single-microphone systems, multiple-microphone systems may provide enhanced noise suppression (e.g., stationary noise suppression and non-stationary noise suppression) and may permit the audio processing systems to enable spatial-related audio features, such as position-dependent noises.

However, performance of the audio processing system may be degraded when there is a gain (e.g., sensitivity) mismatch between the microphones of the multiple-microphone system. Gain calibration calculation to correct such gain mismatches can be inaccurate and may be a significant burden on processing resources.

IV. SUMMARY

A method and an apparatus is disclosed for automated gain matching with respect to multiple microphones. Audio signals from multiples microphones may be digitally sampled at particular time instances to create digital data frames. For example, an audio signal from a reference microphone may be digitally sampled at a first time to generate a reference data frame, and an audio signal from a target microphone may also be digitally sampled at the first time to generate a target data frame. A single-source identifier (SSI) may determine that one source is present in the reference data frame and may determine that one source is present in the target data frame. A single channel signal detector (SC-SD) may determine whether the one source corresponds to speech or to background noise for both data frames. If the one source corresponds to background noise for both data frames, a power ratio associated with the power of the reference data frame and the power of the target data frame may be determined. The power ratio may be added to a histogram of power ratios to determine a gain calibration value for adjusting the gain of the target microphone. For example, the gain calibration value may be based on a particular power ratio in the histogram that has the highest count.

In a particular embodiment, a method includes receiving, at a processor, a first data frame at a first time from a first microphone. The method also includes receiving a second data frame at the first time from a second microphone. The method further includes calculating a power ratio of the first microphone and the second microphone based on the first data frame and the second data frame in response to determining that the first data frame and the second data frame are noise data frames.

In another particular embodiment, an apparatus includes a processor and a memory accessible to the processor. The memory stores instructions that are executable by the processor to cause the processor to receive a first data frame at a first time from a first microphone. The instructions also cause the processor to receive a second data frame at the first time from a second microphone. The instructions also cause the processor to calculate a power ratio of the first microphone and the second microphone based on the first data frame and the second data frame in response to determining that the first data frame and the second data frame are noise data frames.

In another particular embodiment, an apparatus includes means for receiving a first data frame at a first time from a first microphone. The apparatus also includes means for receiving a second data frame at the first time from a second microphone. The apparatus further includes means for calculating a power ratio of the first microphone and the second microphone based on the first data frame and the second data frame in response to determining that the first data frame and the second data frame are noise data frames.

In another particular embodiment, a computer-readable storage medium including instructions that, when executed by a processor, cause the processor to receive a first data frame at a first time from a first microphone. The instructions may also cause the processor to receive a second data frame at the first time from a second microphone. The instructions may also cause the processor to calculate a power ratio of the first microphone and the second microphone based on the first data frame and the second data frame in response to determining that the first data frame and the second data frame are noise data frames.

One particular advantage provided by at least one of the disclosed embodiments is an ability to generate fast and accurate estimates of microphone gain mismatches. Another particular advantage provided by at least one of the disclosed embodiments is an increased stability of microphone gain mismatch calculations, when compared to the minimum statistics algorithm, and an ability to adapt estimates of microphone gain mismatches to different types of background noise or noise spectra shapes. Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
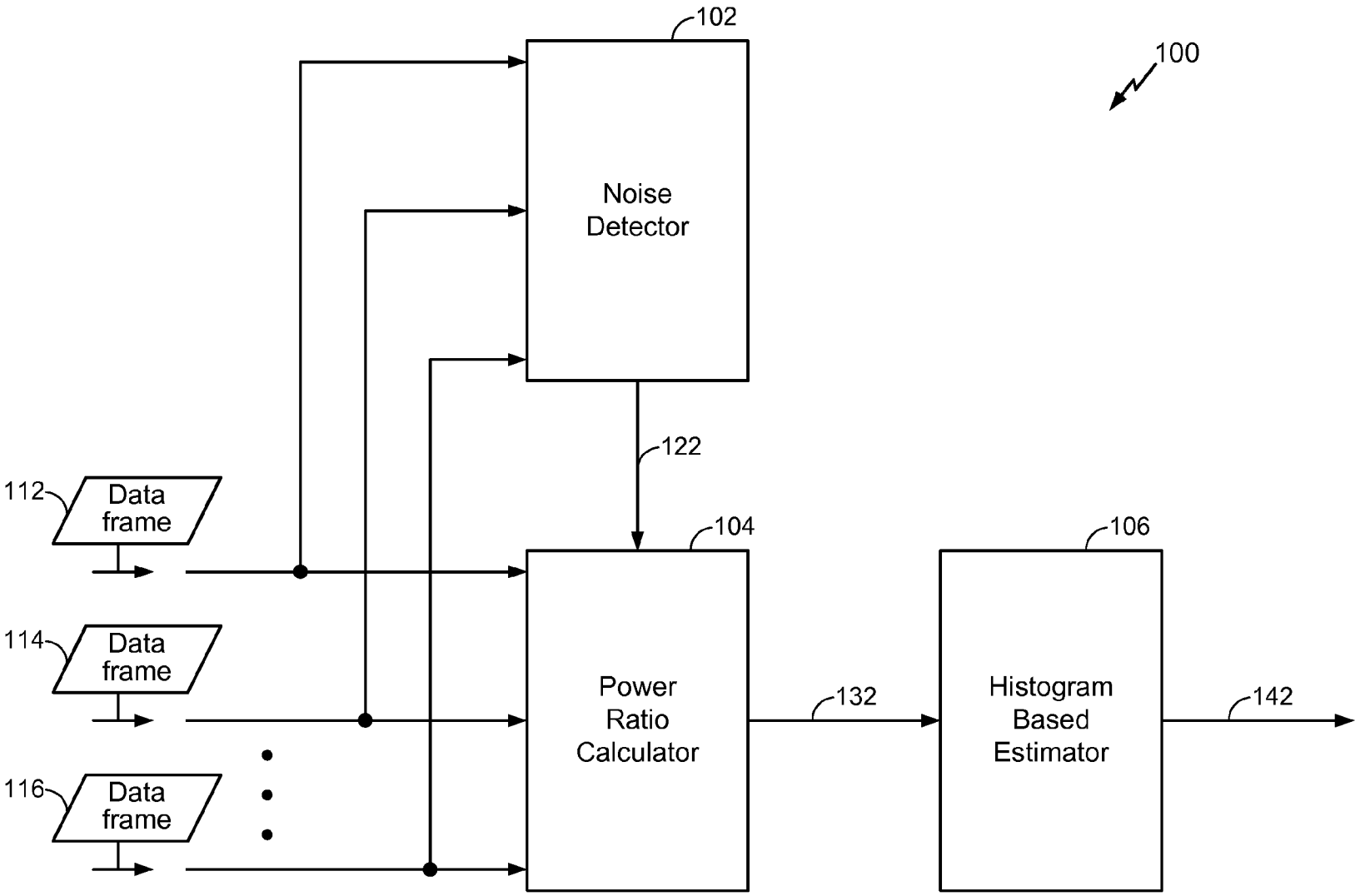
FIG. 1 is a block diagram of a particular illustrative embodiment of a system that is operable to determine a gain calibration value for a target microphone.

Referring to FIG. 1, a particular illustrative embodiment of a system 100 that is operable to determine a gain calibration value for a target microphone is shown. The system 100 includes a noise detector 102, a power ratio calculator 104, and a histogram based estimator 106. The noise detector 102 is coupled to the power ratio calculator 104, and the power ratio calculator 104 is coupled to the histogram based estimator 106. In a particular embodiment, the noise detector 102, the power ratio calculator 104, and the histogram based estimator 106 may be included in a processor or may include instructions that are executable by the processor.

The noise detector 102 and the power ratio calculator 104 are configured to receive and process multiple data frames. For example, a first data frame 112, a second data frame 114, and an $N^{th}$ data frame 116 may be provided to the noise detector 102 and to the power ratio calculator 104, where N is any integer greater than one. For example, if N is equal to 4, then four data frames are provided to the noise detector 102 and to the power ratio calculator 104. Each data frame 112-116 may correspond to digitized audio samples that are generated from analog audio from corresponding microphones. The analog audio from the corresponding microphones may be sampled at the same time (e.g., a first time) to generate the data frames 112-116. For example, the first data frame 112 may correspond to a first digitized audio sample of first analog audio from a first microphone (not shown), the second data frame 114 may correspond to a second digitized audio sample of second analog audio from a second microphone (not shown), and the $N^{th}$ data frame 116 may correspond to an $N^{th}$ digital audio sample of $N^{th}$ analog audio from an $N^{th}$ microphone (not shown). The first analog audio, the second analog audio, and the $N^{th}$ analog audio may be sampled at the first time to generate the first data frame 112, the second data frame 114, and the $N^{th}$ data frame, respectively. The first time may correspond to a particular time period. For example, in a particular embodiment, the first time may correspond to a particular clock cycle. In a particular embodiment, the first microphone may be a reference microphone and each additional microphone may be a target microphone.

Each data frame 112-116 may be a speech data frame, a noise data frame, or a multiple source data frame (e.g., a data frame that includes a substantial amount of speech and a substantial amount of noise). In a particular embodiment, a speech data frame may include a substantial amount of data that corresponds to speech and minimal (or zero) data that corresponds to background noise. A noise data frame may include a substantial amount of data that corresponds to background noise and minimal (or zero) data that corresponds to speech. In response to receiving the data frames 112-116, the noise detector 102 may be configured to determine whether each data frame 112-116 is a noise data frame. For example, the noise detector 102 may determine whether each data frame 112-116 is a single source data frame (e.g., corresponds to a single type of audio data) or a multiple source data frame. To illustrate, a single source data frame may be a speech data frame or a noise data frame. A multiple source data frame may be a data frame that includes a substantial amount of noise and speech. Such data frames include data that corresponds to two types of audio data (e.g., the noise type and the speech type). As an illustrative example, the noise detector 102 may determine whether the first data frame 112 is a speech data frame, a noise data frame, or a multiple source data frame. Likewise, the noise detector 102 may determine whether each of the second data frame 114 and the $N^{th}$ data frame 116 is a speech data frame, a noise data frame, or a multiple source data frame. The noise detector 102 is configured to delete (or cease processing for purposes of gain matching) each data frame 112-116 associated with a particular sampling time (or time index) in response to a determination that any one data frame 112-116 associated with the particular sampling time (or time index) is a multiple source data frame. To illustrate, if the first data frame 112 is determined to include data that corresponds to noise and speech, the first data frame 112, the second data frame 114, and the $N^{th}$ data frame 116 may all be dropped (e.g., processing of each of the data frames 112-116 may cease for purposes of gain matching).

When each data frame 112-116 is a single source data frame (e.g., corresponds to a single type of audio data), the noise detector 102 may identify whether each data frame 112-116 is a noise data frame or a speech data frame. To illustrate, the noise detector 102 may determine whether the first data frame 112 is a speech data frame, the noise detector 102 may determine whether the second data frame 114 is a speech data frame, etc. In response to a determination that each data frame 112-116 is not a speech data frame, the noise detector 102 may generate an activation signal 122 to enable (e.g., activate) the power ratio calculator 104. For example, a determination that each data frame 112-116 is not a speech data frame may indicate that each data frame 112-116 is a noise data frame.

The power ratio calculator 104 is configured to receive each of the data frames 112-116 and to calculate a power ratio of the first microphone (e.g., the reference microphone) and each target microphone in response to receiving the activation signal 122 from the noise detector 102. For example, the power ratio calculator 104 may calculate a first power ratio of the first microphone and the second microphone based on the first data frame 112 and the second data frame 114. Additionally, the power ratio calculator 104 may calculate an $(N-1)^{th}$ power ratio of the first microphone and the $N^{th}$ microphone based on the first data frame 112 and the $N^{th}$ data frame 116. In a particular embodiment, the power ratio calculator 102 may utilize time domain averaging (e.g., smoothing) when determining the power ratios. The power ratio calculator 104 may generate a strength signal 132 indicating the first power ratio and the second power ratio. The strength signal 132 may be provided to the histogram based estimator 106. In a particular embodiment, the first power ratio may correspond to a gain calibration value for a particular microphone. For example, the first power ratio (corresponding to the power ratio between the first microphone and the second microphone) may correspond to a gain calibration value 142 for the second microphone.

The histogram based estimator 106 is configured to receive the strength signal 132 from the power ratio calculator 104 and to maintain histograms for each power ratio. In a particular embodiment, the histograms are used to determine the gain calibration value 142 for each target microphone. For example, the estimated gain calibration values 142 for each target microphone may be generated by finding peaks in corresponding histograms. The peak may correspond to a power ratio in the histogram that appears most frequently. For example, the first power ratio (corresponding to the power ratio between the first microphone and the second microphone) may correspond to −1 decibel (dB). The first power ratio may be provided to the histogram based estimator 106 via the strength signal 132. The histogram based estimator 106 may add the first power ratio to a histogram associated with other power ratios between the first microphone and the second microphone and determine which power ratio occurs most frequently in the histogram. The power ratio that occurs most frequently (e.g., the particular power ratio with the highest count) may correspond to the gain calibration value 142 for the second microphone.

Determining calibration values based on data frames 112-116 when the data frames are noise data frames may permit the system 100 to converge quickly and accurately in real-time audio applications. For example, the system 100 may generate fast and accurate estimates of microphone gain mismatches. Using histograms of power ratios may provide increased stability of microphone gain mismatch calculations when compared to the minimum statistics algorithm, and an ability to adapt estimates of microphone gain mismatches to different types of background noise or noise spectra shapes.

Figure 2:
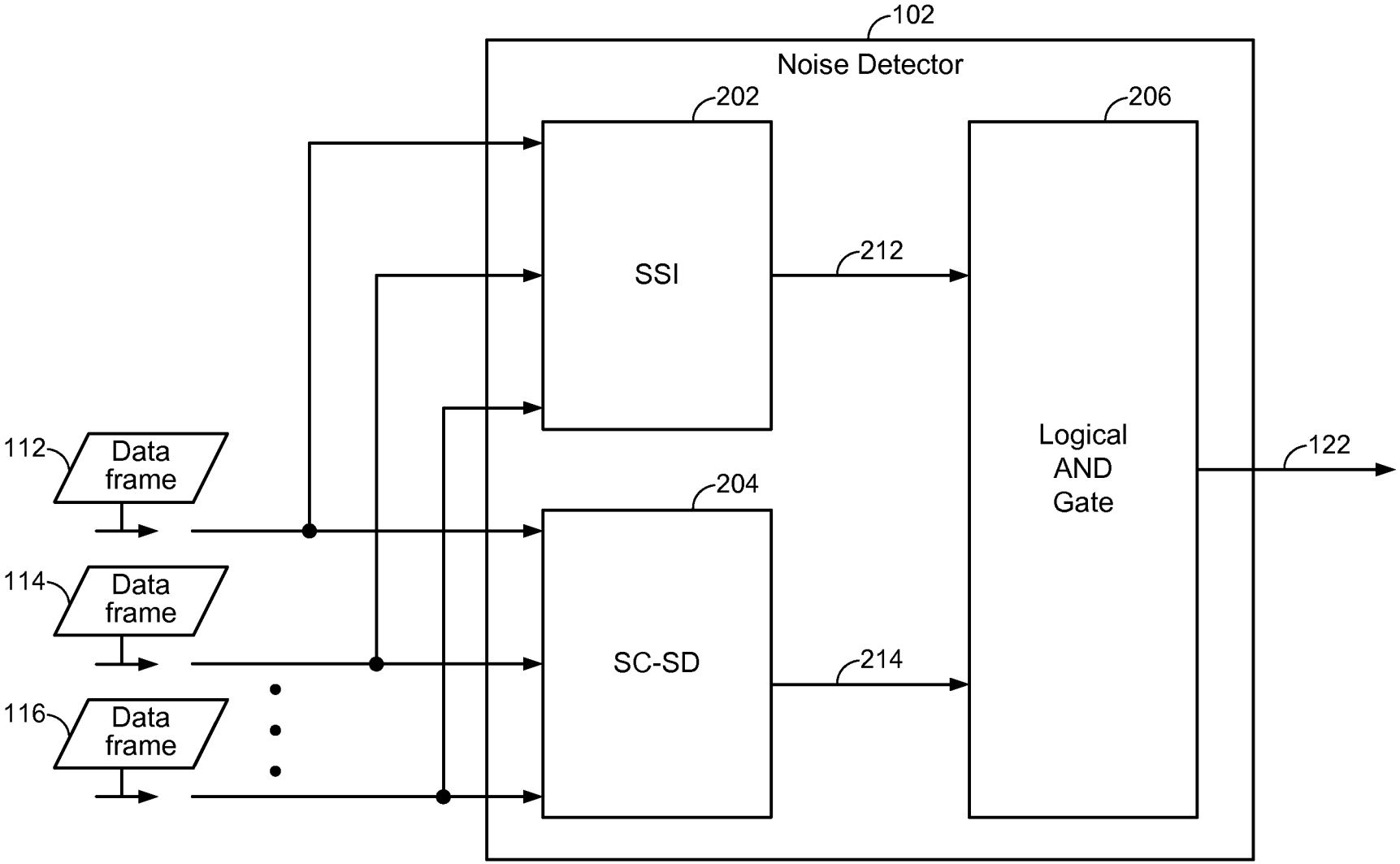
FIG. 2 is a block diagram of a particular illustrative embodiment of a noise detector.

Referring to FIG. 2, a particular illustrative embodiment of the noise detector 102 is shown. The noise detector 102 includes a single-source identifier (SSI) module 202, a single channel signal detector (SC-SD) module 204, and a logical AND gate 206. The SSI module 202 may be coupled to a first input of the logical AND gate 206 and the SC-SD module 204 may be coupled to a second input of the logical AND gate 206.

The first data frame 112 corresponding to the first microphone (e.g., the reference microphone) may be represented as $x_1(t)=s(t)+n(t)$, where s(t) corresponds to a directional source signal and where n(t) is a distributed background noise. In a particular embodiment, s(t) may correspond to speech. The second data frame 114 corresponding to the second microphone (e.g., the target microphone) may be represented as $x_2(t)=\gamma*s(t)+\beta*n(t)$, where (γ) corresponds to a difference in strength between the directional source of the first data frame 112 and the second data frame 114, and where (β) characterizes the gain mismatch between the first microphone and the second microphone. In real time applications, the directional source s(t), the background noise n(t), the difference in strength (γ), and the gain mismatch (β) may be unknown when the first data frame 112 and the second data frame 114 are received by the noise detector 102. In a particular embodiment, the $N^{th}$ data frame 116 may be represented as $x_N(t)=\gamma_N*s(t)+\beta N*n(t)$, where ($\gamma_N$) corresponds to a difference in strength between the directional source of the first data frame 112 and the $N^{th}$ data frame 116, and where ($\beta_N$) characterizes the gain mismatch between the first microphone and the $N^{th}$ microphone.

The SSI module 202 may be configured to determine whether each data frame 112-116 is a single source data frame or a multiple source data frame. For example, each data frame 112-116 may be provided to the SSI module 202. The SSI module 202 may detect the noise data frames and the speech data frames (e.g., the single source data frames). For example, a single source data frame may include noise n(t) or a signal s(t) (e.g., speech). In a particular embodiment, the SSI module 202 may determine whether each data frame 112-116 is a single source data frame based on a direction of sound components associated with the data frames 112-116. For example, a single source data frame may correspond to a data frame having sound components that come from a single direction (e.g., unidirectional sound components).

In another particular embodiment, the SSI module 202 may determine whether each data frame 112-116 is a multiple source data frame. In response to a determination that a particular data frame 112-116 is not a multiple source data frame, the SSI module 202 may determine that the particular data frame 112-116 is a single source data frame. A multiple source data frame may correspond to a data frame having sound components that come from multiple directions. Alternatively, or in addition, a multiple source data frame may correspond to a data frame where two or more sound components are detected as having an amplitude (e.g., based on a measured decibel level) that exceeds a particular threshold and that are detected as coming from different source directions.

In another particular embodiment, a matrix (e.g., a covariance matrix as described below) may be used to determine whether each data frame 112-116 is a single source data frame. For ease of illustration, the following description corresponds to determining whether the first and second data frames 112, 114 are single source data frames. However, the techniques used herein may be extended to determine whether other data frames (e.g., the $N^{th}$ data frame 116) are single source data frames. Also, for ease of description, the signal s(t) is described herein as speech; however, in other embodiment, other signal types may be present.

Using the first data frame 112 (e.g., $x_1(t)=s(t)+n(t)$) and the second data frame 114 (e.g., $x_2(t)=\gamma*s(t)+\beta*n(t)$), data from a first time (e.g., t=k+1) to an $T^{th}$ time (e.g., t=k+T) may be used to obtain $$P_1(k)=\sum_{t=k+1}^{k+T} x_1(t)x_1(t)=P_s(k)+P_n(k)$$

$$P_X(k)=\sum_{t=k+1}^{k+T} x_1(t)x_2(t)=\gamma P_s(k)+\beta P_n(k)$$

$$P_2(k)=\sum_{t=k+1}^{k+T} x_2(t)x_2(t)=\gamma^2 P_s(k)+\beta^2 P_n(k)$$

$P_1(k)$ may correspond to a power level of a channel corresponding to the first microphone, $P_x(k)$ may correspond to a correlation between the first microphone and the second microphone, and $P_2(k)$ may correspond to a power level of a channel corresponding to the second microphone. $P_s(k)$ may correspond to a power level of the speech s(t) at the $k^{th}$ frame, and $P_n(k)$ may correspond to the power level of the noise n(t) at the $k^{th}$ frame. In a particular embodiment, s(t) and n(t) are not correlated. The vector notation of the three equations may be expressed as $$Y_k = \begin{bmatrix} P_1(k) \\ P_X(k) \\ P_2(k) \end{bmatrix} = \begin{bmatrix} 1 & 1 \\ \gamma & \beta \\ \gamma^2 & \beta^2 \end{bmatrix} \begin{bmatrix} P_s(k) \\ P_n(k) \end{bmatrix}$$

Thus, vectors corresponding to successive time indices from a first time to an $L^{th}$ time may be represented as a matrix (H), where $$H = [Y_1, Y_2, Y_3, \ldots, Y_L] = \begin{bmatrix} 1 & 1 \\ \gamma & \beta \\ \gamma^2 & \beta^2 \end{bmatrix} \begin{bmatrix} P_s(1) \ldots P_s(L) \\ P_n(1) \ldots P_n(L) \end{bmatrix}.$$

When a data frame is a single source data frame (e.g., a speech data frame or a noise data frame), the rank of the matrix (H) may be equal to one. However, if the data frame is a multiple source data frame (e.g., a substantial amount of speech s(t) and noise n(t) are present), the rank of the matrix (H) may be equal to two. Thus, the SSI module 202 may detect the frames where one source (e.g., one type of audio data) is present by detecting the rank of the matrix (H). However, when one source is present (i.e., when the matrix (H) has a rank of one), the analysis of the matrix (H) does not indicate which type of audio data is present.

In a particular embodiment, calculations by the SSI module 202 may be simplified by utilizing eigenvalue decomposition of a covariance matrix (R) to determine whether each data frame 112-116 corresponds to a single type of audio data. The covariance matrix may be expressed as $$R = HH^T = V \begin{bmatrix} \lambda_1 & & \\ & \lambda_2 & \\ & & \lambda_3 \end{bmatrix} V^T,$$

where V is the eigen-matrix of the covariance matrix (R), and $\lambda_i$ are the corresponding eigen values with $\lambda_1 > \lambda_2 > \lambda_3 > 0$. Determining whether each data frame 112-116 corresponds to a single type of audio data may then be accomplished by the following comparison $$\frac{\lambda_1 - \lambda_3}{\lambda_2 - \lambda_3} \geq t_\lambda.$$

If the comparison is true (e.g., if the left-hand-side of the above equation is greater than or equal to the threshold $t_\lambda$), then each of the compared data frames (i.e., the first data frame 112 and the second data frame 114, in the above example) are single source data frames. For example, if the comparison is true, then each of the compared data frames corresponds to noise n(t) or corresponds to speech s(t) (e.g., correspond to a single type of audio data). The SSI module 202 may generate a signal 212 indicating whether each of the compared data frames is a single source data frame. For example, when each of the compared data frames is a single source data frame, the SSI module 202 may generate a logical high voltage signal (e.g., a logical "1" value) and provide the logical high voltage signal to the first input of the logical AND gate 206. Conversely, when one or more of the compared data frames corresponds to multiple types of audio data (e.g., noise and speech), the SSI module 202 may generate a logical low voltage signal (e.g., a logical "0" value) and provide the logical low voltage signal to the first input of the logical AND gate 206.

Figure 3:
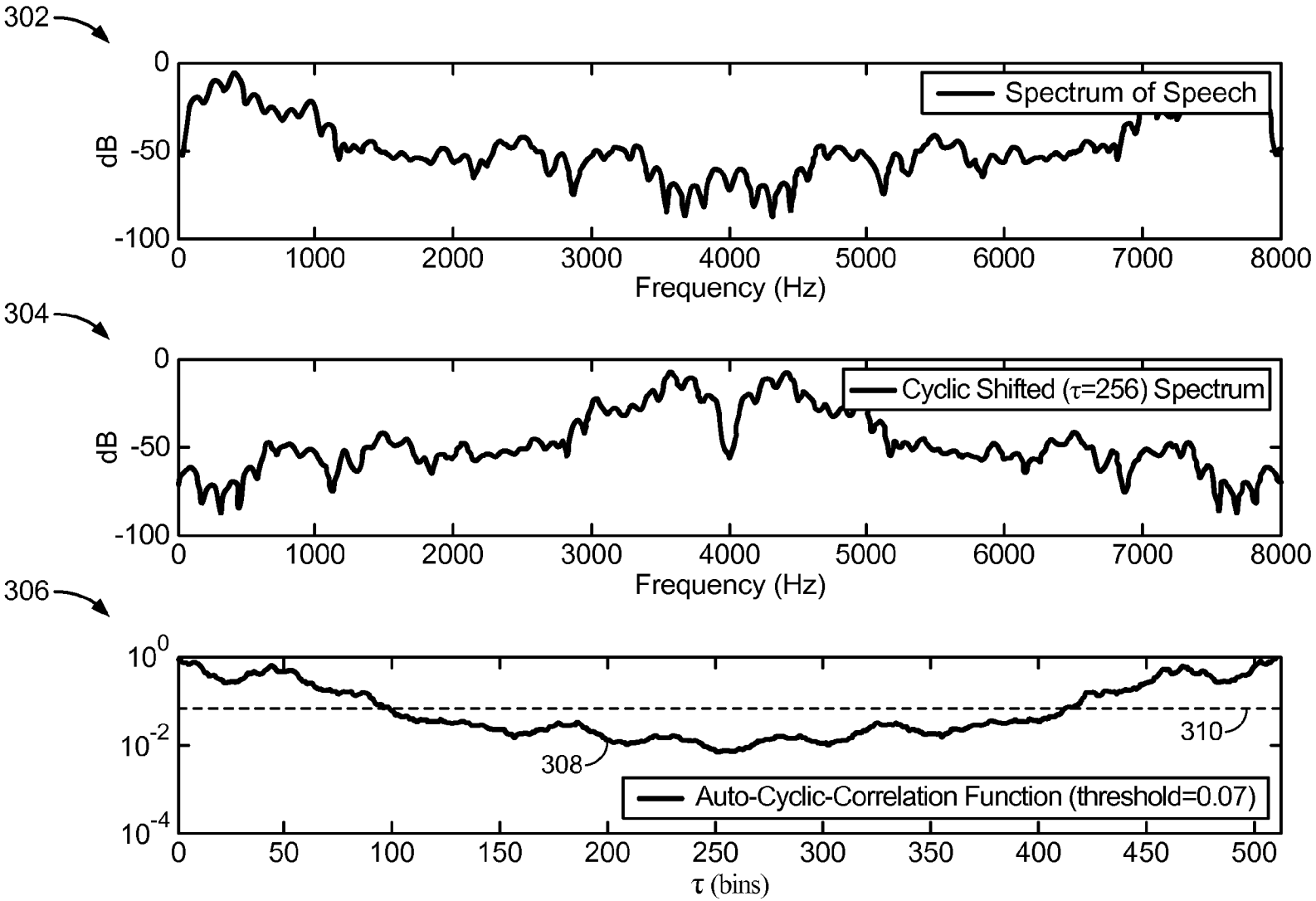
FIG. 3 illustrates a frequency spectrum of human speech from a particular frame, a cyclically shifted version of the frequency spectrum, and an auto-cyclic-correlation function.

The SC-SD module 204 may be configured to detect whether each data frame 112-116 is a speech data frame. For example, for the first data frame 112 (e.g., $x_1(t)=s(t)+n(t)$), the SC-SD module 204 may determine whether audio data corresponding to speech s(t) is present or whether audio data corresponding to speech s(t) is absent. The SC-SD module 204 may make similar determinations for the other data frames 114, 116. In a particular embodiment, the SC-SD module 204 is a single channel voice activity detector (SC-VAD). For example, the SC-SD module 204 may be configured to detect frames having a strong speech s(t) component. In a particular embodiment, the SC-SD module 204 uses a speech detection process that is based on a harmonic structure in human speech, which is usually low-frequency concentrated. Referring to FIG. 3, a first graph 302 of a frequency spectrum of human speech for a particular data frame 112-116 is shown.

The speech detection process used by the SC-SD module 204 may be based on a single frame so that no error propagates from frame to frame during evaluation. Additionally, the speech detection process may be memory efficient and easily tunable. Further, the speech detection process is independent of input level.

For a particular data frame 112-116, the SC-SD module 204 may determine a magnitude of the particular data frame's 112-116 Fourier coefficients, $S_f(k)$, where k (e.g., $1, \ldots, N_f$) is a frequency index, and $N_f$ is a number of frequency bins. The speech detection process may also determine a cyclically shifted version of the Fourier coefficients ($S_f(k)$), which may be represented as $C_f(k,\tau)$, where $\tau$ is the amount of the shift. For example, the shifted version of the Fourier coefficients may be expressed as $C_f(k,\tau)=S_f((k+\tau)\%\%N_f)$, where % represents a modulation operation. Referring to FIG. 3, a second graph 304 of a cyclically shifted version of frequency spectrum of the human speech for the particular data frame 112-116 is shown. The speech detection process may also determine an auto-cyclic-correlation function, $\phi(\tau)$, which may be computed as:

$$\varphi(\tau) = \frac{\sum_{k=1}^{N_f} C_f(k, \tau) S_f(k)}{\sum_{k=1}^{N_f} S_f(k) S_f(k)}.$$

Referring to FIG. 3, a third graph 306 of the auto-cyclic-correlation function is shown. A minimum value 308 of the auto-cyclic-correlation function, $\phi(\tau)$, may be identified by evaluating the above equation using different amounts of the shift (e.g., for different values of $\tau$). If the minimum value 308 is lower than a threshold 310, then the particular data frame 112-116 may be classified as a speech data frame; otherwise, the particular data frame 112-116 may be classified as a noise data frame. A value of the threshold 310 may be selected and/or modified to tune the speech detection process.

Referring back to FIG. 2, the SC-SD module 204 may generate a signal 214 indicative of whether the particular data frame 112-116 is a speech data frame. For example, if the particular data frame 112-116 is classified as a noise data frame, the SC-SD module 204 may generate a logical high voltage signal (e.g., a logical "1" value) and provide the logical high voltage signal to the second input of the logical AND gate 206. If the particular data frame 112-116 is classified as a speech data frame, the SC-SD module 204 may generate a logical low voltage signal (e.g., a logical "0" value) and provide the logical low voltage signal to the second input of the logical AND gate 206.

The logical AND gate 206 is configured to receive the signal 212 from the SSI module 202 at the first input and to receive the signal 214 from the SC-SD module 204 at the second input. The logical AND gate 206 is configured to output the activation signal 122 based on the signals 212-214 received from the SSI module 202 and the SC-SD modules, respectively. For example, in response to the SSI module 202 generating a logical high voltage signal and the SC-SD module 204 generating a logical high voltage signal, the logical AND gate 206 may generate a logical high voltage activation signal (e.g., enabling the power ratio calculator 104 of FIG. 1). In response to either the SSI module 202 or the SC-SD module 204 generating a logical low voltage signal, the logical AND gate 206 may generate a logical low voltage activation signal (e.g., disabling the power ratio calculator 104 of FIG. 1) and the data frames 112-116 may be dropped (e.g., not used for subsequent gain matching calculations).

Figure 4:
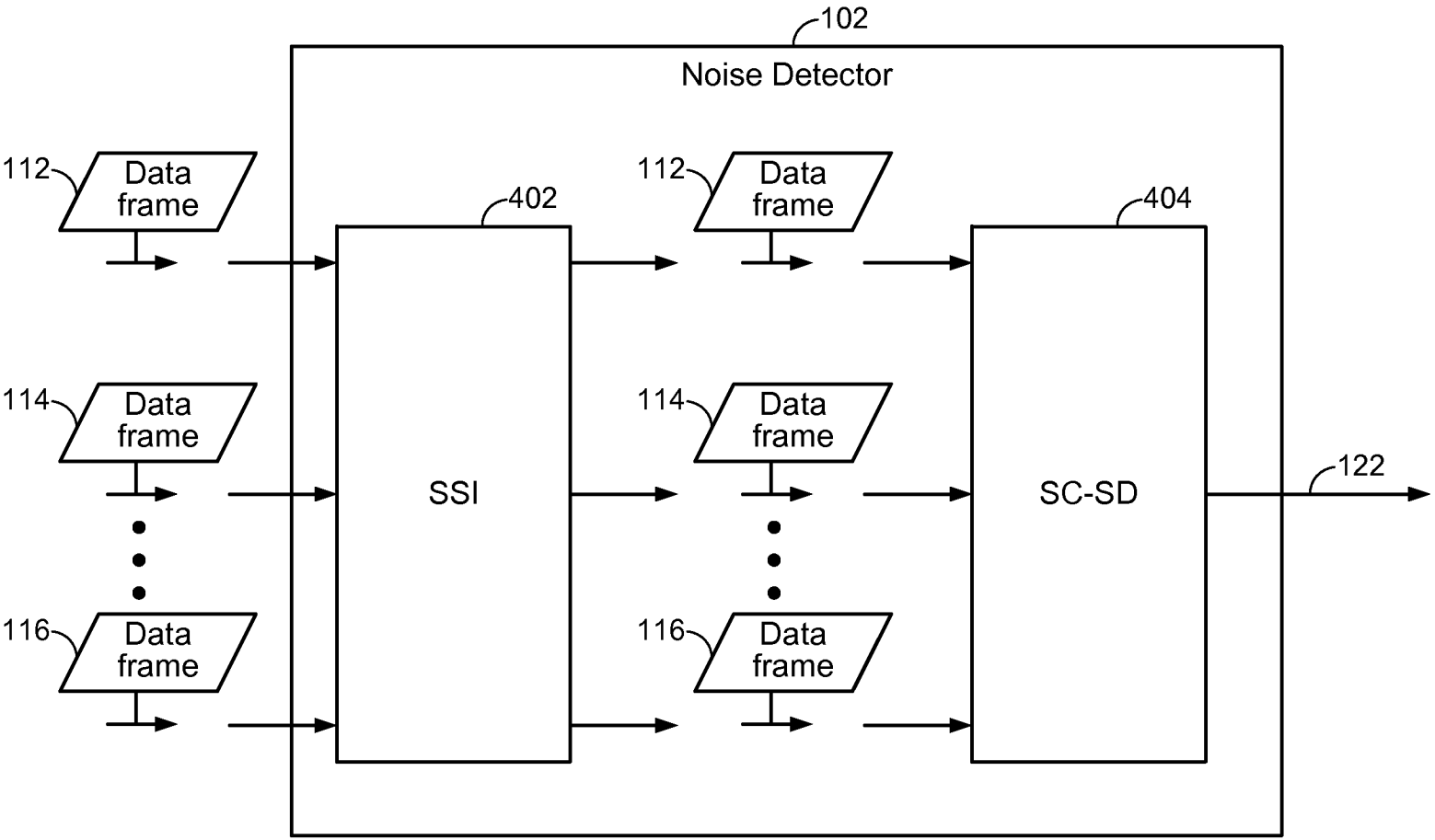
FIG. 4 is a block diagram of another particular illustrative embodiment of a noise detector.

Referring to FIG. 4, another particular illustrative embodiment of the noise detector 102 is shown. The noise detector 102 includes an SSI module 402 and a SC-SD module 404.

The SSI module 402 may correspond to the SSI module 202 of FIG. 2 and may operate in a substantially similar manner. However, in response to determining that each of the data frames 112-116 is a single source data frame, the SSI module 402 of FIG. 4 may provide the data frames 112-116 to the SC-SD module 404. In response to determining that one or more of the data frames 112-116 are multiple source data frames, the SSI module 402 may be configured to drop the data frames 112-116 (e.g., cease processing the data frames 112-116 for gain matching calculations).

The SC-SD module 404 may correspond to the SC-SD module 204 of FIG. 2 and may operate in a substantially similar manner. However, the SC-SD module 404 may receive the data frames 112-116 from the SSI module 402 if the SSI module 402 determines that each of the data frames 112-116 is a single source data frame. Also, in response to determining that each of the data frames 112-116 is classified as a noise data frame, the SC-SD module 404 may generate a logical high voltage activation signal (e.g., enabling the power ratio calculator 104 of FIG. 1). In response to determining that one or more of the data frames 112-116 is classified as a speech data frame, the SC-SD module 404 may generate a logical low voltage activation signal (e.g., disabling the power ratio calculator 104 of FIG. 1). In a particular embodiment, the data frame 112-116 may be dropped (e.g., omitted from subsequent gain matching calculations) in response to determining that one or more of the data frames 112-116 is classified as including speech s(t).

Figure 5:
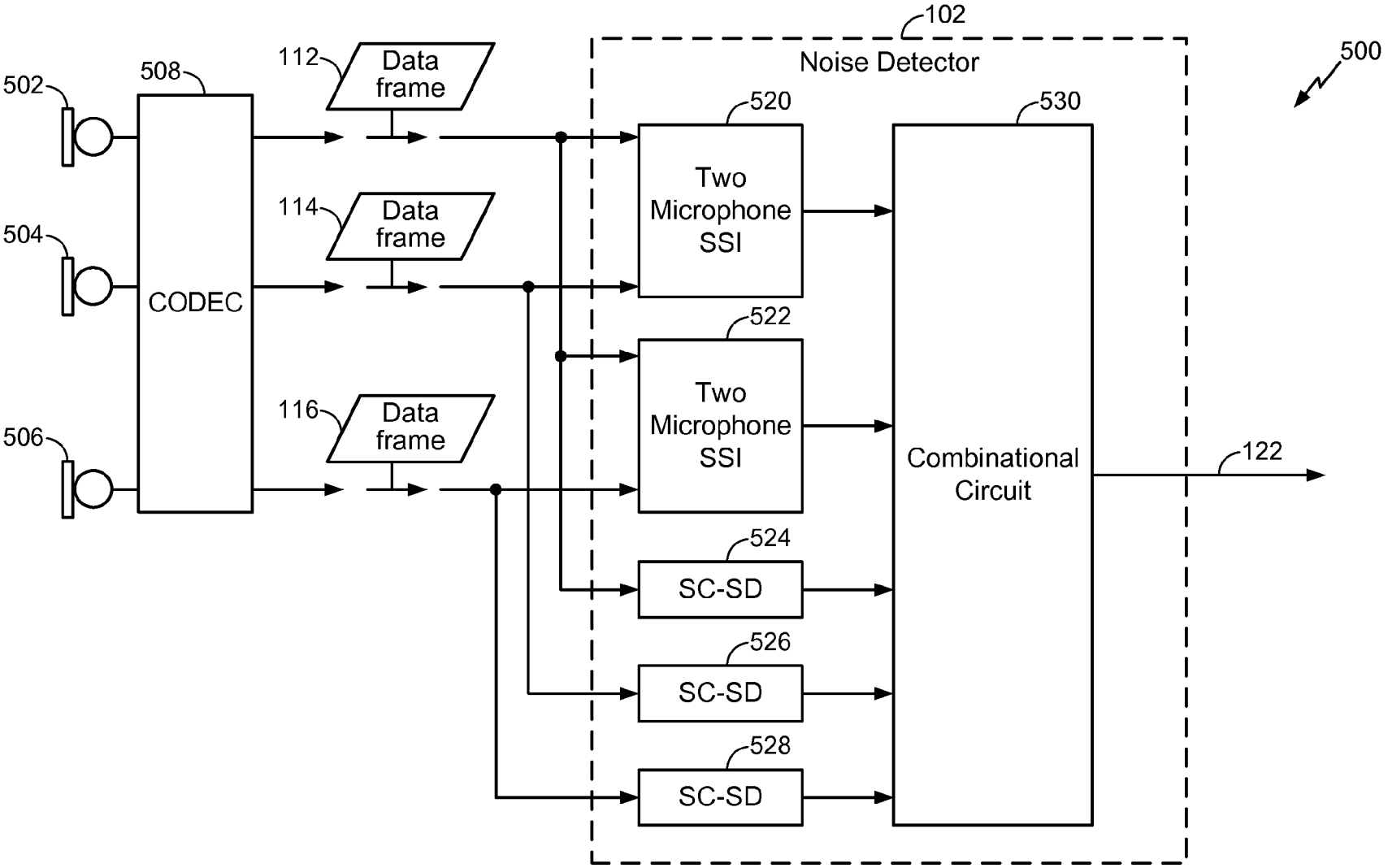
FIG. 5 is a block diagram of a particular illustrative embodiment of a system that is operable to determine whether data frames are noise data frames.

Referring to FIG. 5, a particular illustrative embodiment of a system 500 that is operable to determine whether data frames is noise data frames is shown. The system 500 may include a first microphone 502, a second microphone 504, an $N^{th}$ microphone 506, an encoder/decoder (CODEC) 508, and the noise detector 102. In a particular embodiment, the first microphone 502 may be a reference microphone, the second microphone 504 may be a target microphone, and the $N^{th}$ microphone may be a target microphone.

The first microphone 502 may generate a first analog audio signal and provide the first analog audio signal to the CODEC 508. The CODEC 508 may digitally sample the first analog audio signal at a first time to generate the first data frame 112. The second microphone 504 may generate a second analog audio signal and provide the second analog audio signal to the CODEC 508. The CODEC 508 may digitally sample the second analog audio signal at the first time to generate the second data frame 114. The $N^{th}$ microphone 506 may generate an $N^{th}$ analog audio signal and provide the $N^{th}$ analog audio signal to the CODEC 508. The CODEC 508 may digitally sample the $N^{th}$ analog audio signal at the first time to generate the $N^{th}$ data frame 116.

The data frames 112-116 are provided to another particular illustrative embodiment of the noise detector 102. For example, the noise detector 102 includes a first two microphone SSI module 520 and an $(N-1)^{th}$ two microphone SSI module 522. Each two microphone SSI module 520, 522 may correspond to the SSI module 202 of FIG. 2 and may operate in a substantially similar way with respect to the respective input data frames 112-116. For example, the first two microphone SSI module 520 may determine whether the first data frame 112 and the second data frame 114 are single source data frames. The noise detector 102 may also include an SC-SD module for each microphone. For example, the noise detector 102 may include a first SC-SD module 524 to process the first data frame 112, a second SC-SD module 524 to process the second data frame 114, and an $N^{th}$ SC-SD module 528 to process the $N^{th}$ data frame 116. Each of the SC-SD modules 524-528 may correspond to the SSI module 204 of FIG. 2 and may operate in a substantially similar way with respect to the respective input data frames 112-116.

The noise detector 102 may also include a combinational circuit 530. In a particular embodiment, the combinational circuit 530 may be a logic gate or a series of logic gates configured to receive input signals from each two microphone SSI module 520, 522 and from each SC-SD module 524-528. In response to the input signals, the combinational circuit 530 may generate an activation signal 122. For example, when the input signals indicate that each of the data frames 112-116 is a single source data frame and that each of the data frames is classified as a noise data frame, the combinational circuit 530 may generate a logical high value (e.g., enabling the power ratio calculator 104 of FIG. 1). In response to the input signals indicating that one or more of the data frames 112-116 are multiple source data frames or indicating that at least one of the data frames is classified a speech data frame, the combinational circuit 530 may generate a logical low value (e.g., disabling the power ratio calculator 104 of FIG. 1) and the data frames 112-116 are dropped (e.g., omitted from subsequent gain matching calculations).

While several embodiments of the noise detector 102 have been illustrated, other embodiments are possible. For example, in another particular embodiment, the noise detector 102 may include a three microphones SSI module configured to receive three data frames generated from analog audio from three microphones. In another particular embodiment, a combinational circuit may selectively activate each SC-SD module 524-528 based on an output of each two microphone SSI module 520, 522. For example, in response to a determination by the first two microphone SSI module 520 that the first and the second data frames 112, 114 are single source data frames, the combinational circuit may activate the first and second SC-SD modules 524, 526. Additionally, in response to a determination by the $(N-1)^{th}$ two microphone SSI module 522 that the $N^{th}$ data frame 116 are multiple source data frames, the combinational circuit may deactivate the $N^{th}$ SC-SD module 528. Thus, the $N^{th}$ data frame 116 may be omitted from subsequent gain matching calculations while gain matching calculations with respect to the first and second data frames 112, 114 proceed.

Figure 6:
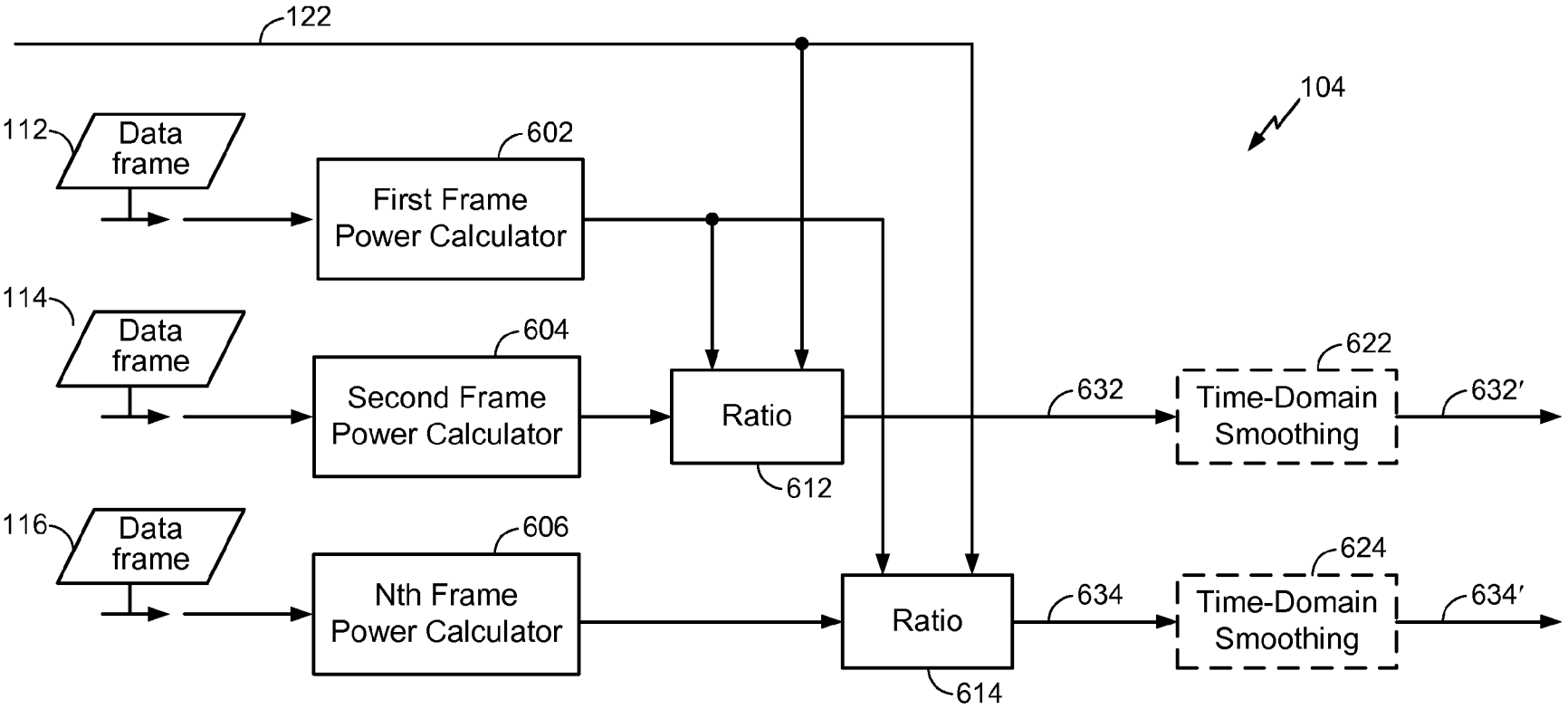
FIG. 6 is a block diagram of a particular illustrative embodiment of a power ratio calculator.

Referring to FIG. 6, a particular illustrative embodiment of the power ratio calculator 104 is shown. The power ratio calculator 104 includes a first frame power calculator module 602, a second frame power calculator module 604, an $N^{th}$ frame power calculator module 606, a first ratio calculator module 612, and an $(N-1)^{th}$ ratio calculator module 614. In a particular embodiment, the power ratio calculator 104 may also include a first time-domain smoothing module 622 and an $(N-1)^{th}$ time-domain smoothing module 624.

The first frame power calculator module 602 is configured to receive the first data frame 112 and to calculate a first frame power of the first data frame 112. A first power signal representative of the first frame power is provided to the first ratio calculator module 612 and to the $(N-1)^{th}$ ratio calculator module 614. The second frame power calculator module 604 is configured to receive the second data frame 114 and to calculate a second frame power of the second data frame 114. A second power signal representative of the second frame power is provided to the first ratio calculator module 312. The $N^{th}$ frame power calculator module 606 is configured to receive the $N^{th}$ data frame 116 and to calculate an $N^{th}$ frame power of the $N^{th}$ data frame 116. An $N^{th}$ power signal representative of the $N^{th}$ frame power is provided to the $(N-1)^{th}$ ratio calculator module 614. In a particular embodiment, the ratio calculator modules 612, 614 may be selectively activated in response to a first activation signal and a second activation signal.

The first ratio calculator module 612 may calculate a first ratio 632 of the first frame power and the second frame power (e.g., calculate a power ratio for the second microphone 504 based on the first microphone 502 (e.g., the reference microphone)). The first ratio 632 may be provided to the histogram based estimator 106 as described with respect to FIG. 7. In a particular embodiment, the first time-domain smoothing module 622 may average or smooth the first ratio 632 in a time domain to remove irregularities (e.g., effects of non-stationary noise) in the first ratio 632 and to generate a first modified ratio 632'. When time-domain smoothing occurs, the first modified ratio 632', as opposed to the first ratio 632, may be provided to the histogram based estimator 106. The $(N-1)^{th}$ ratio calculator module 614 may calculate a $(N-1)^{th}$ ratio 634 of the first frame power and the $(N-1)^{th}$ frame power (e.g., calculate a power ratio for the $N^{th}$ microphone 506 based on the first microphone 502). The $(N-1)^{th}$ ratio 634 may be provided to the histogram based estimator 106 as described with respect to FIG. 7. In a particular embodiment, the $(N-1)^{th}$ time-domain smoothing module 624 may average or smooth the first ratio 632 in a time domain to remove irregularities in the $(N-1)^{th}$ ratio 634 and to generate an $(N-1)^{th}$ modified ratio 634'. When time-domain smoothing occurs, the $(N-1)^{th}$ modified ratio 634', as opposed to the $(N-1)^{th}$ ratio 634, may be provided to the histogram based estimator 106.

Figure 7:
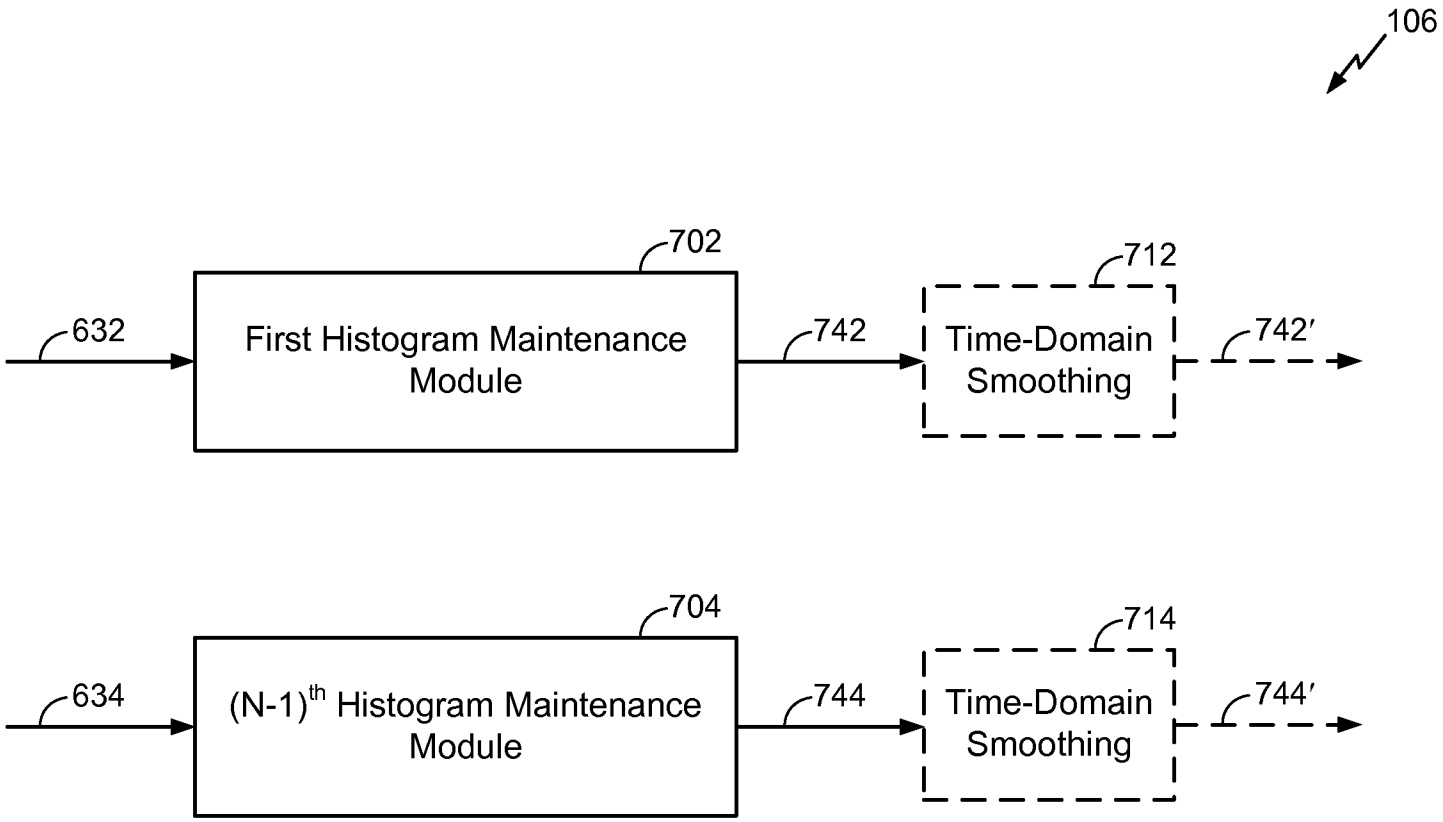
FIG. 7 is a block diagram of a particular illustrative embodiment of a histogram based estimator.

Referring to FIG. 7, a particular illustrative embodiment of the histogram based estimator 106 is shown. The histogram based estimator 106 includes a first histogram maintenance module 702 and an $(N-1)^{th}$ histogram maintenance module 704. In a particular embodiment, the histogram estimator 106 may include a first time-domain smoothing module 712 and an $(N-1)^{th}$ time-domain smoothing module 714.

The first histogram maintenance module 702 is configured to receive the first ratio 632 (or the first modified ratio 632'). The first histogram maintenance module 702 is configured to maintain a histogram of power ratios associated with other data frames received from the first microphone 502 and the second microphone 504 at other particular times. In response to receiving the first ratio 632, the first histogram maintenance module 702 adds the first ratio to the power ratios in the maintained histogram.

Figure 9:
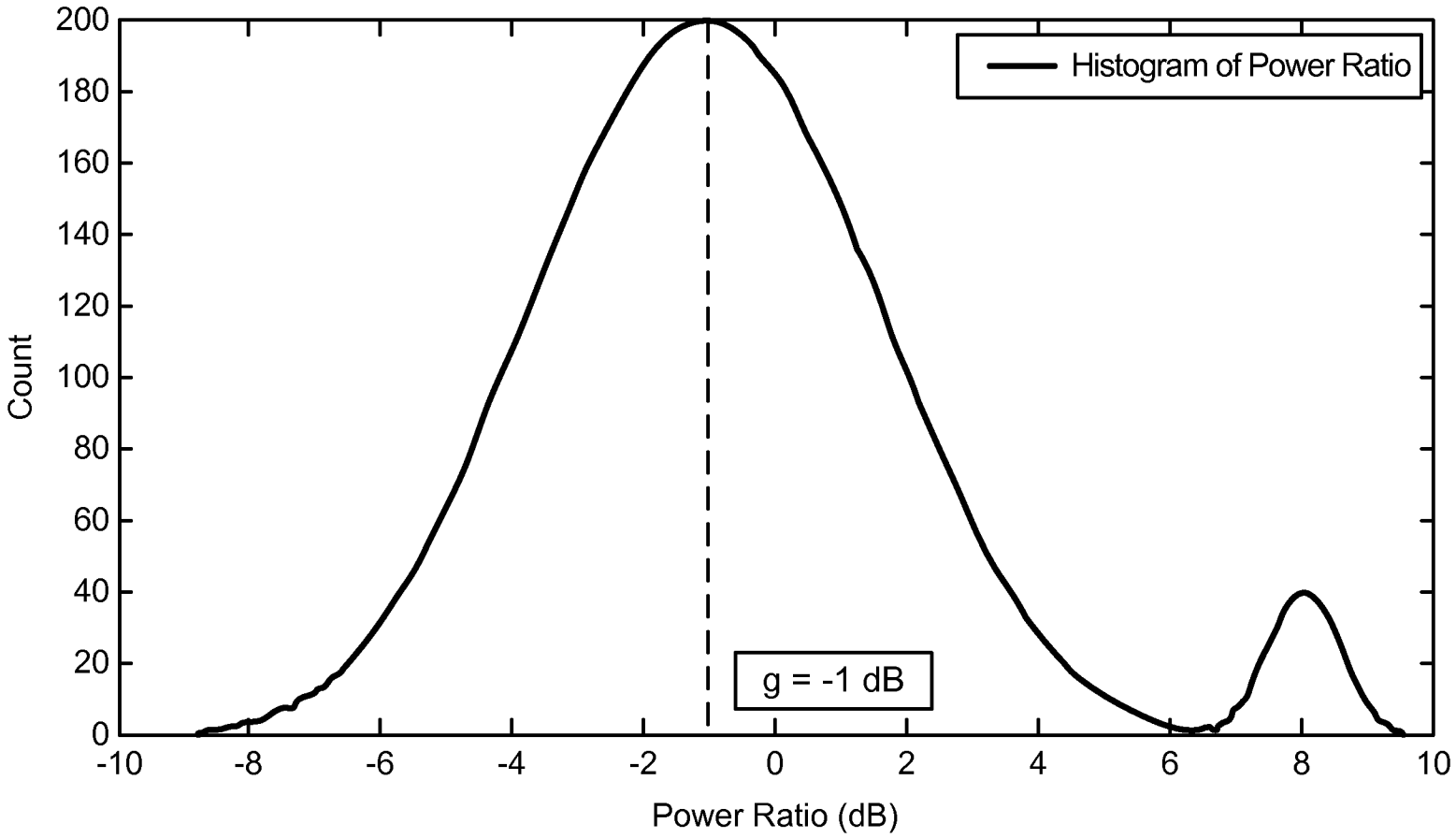
FIG. 9 illustrates a histogram of power value ratios.

For example, referring to FIG. 9, a histogram of power ratios is illustrated. The horizontal axis may correspond to different power ratios and the vertical axis may correspond to a number of times that each power ratio has been detected. For example, if the first ratio 632 corresponds to −1 dB, the count of the number of times that a power ratio of −1 dB has been detected may be increased (e.g., increased from 200 to 201).

Referring back to FIG. 7, the first histogram maintenance module 702 is configured to determine a first gain calibration value 742 based on a power ratio that appears most frequently in the histogram corresponding to the first ratio 632. The first gain calibration value 742 may correspond to the gain calibration value 142 of FIG. 1. For example, referring to FIG. 9, the first histogram maintenance module 702 may determine that a power ratio of −1 dB appears most frequently. In response, the first histogram maintenance module 702 may generate the first gain calibration value 742, where the first gain calibration value 742 is associated with a power ratio of −1 dB. The first gain calibration value 742 may be provided to the second microphone 504.

The $(N-1)^{th}$ histogram maintenance module 704 is configured to receive the $(N-1)^{th}$ ratio 634 (or the $(N-1)^{th}$ modified ratio 634'). The $(N-1)^{th}$ histogram maintenance module 704 is configured to maintain a histogram of power ratios associated with other data frames received from the first microphone 502 and the $N^{th}$ microphone 506 at other particular times. In response to receiving the $(N-1)^{th}$ ratio 634, the $(N-1)^{th}$ histogram maintenance module 704 adds the $(N-1)^{th}$ ratio to the power ratios in the maintained histogram. The $(N-1)^{th}$ histogram maintenance module 704 is configured to determine a $(N-1)^{th}$ gain calibration value 744 based on a power ratio that appears most frequently in the histogram corresponding to the $(N-1)^{th}$ ratio 634. The $(N-1)^{th}$ gain calibration value 744 may correspond to the gain calibration value 142 of FIG. 1.

Each histogram maintenance module 702, 704 may be a short-term histogram maintenance module or a long-term histogram maintenance module. Long-term histogram maintenance modules may store power ratios over a first particular time period, and short-term histogram modules may store power ratios over a second particular time period. In a particular embodiment, the second particular time period is included in the first particular time period; however, the second particular time period is shorter than the first particular time period.

For example, long-term histogram maintenance modules may store each power ratio calculated by a corresponding ratio calculator module, and short-term histogram may only store power ratios calculated within a recent time period (e.g., store power ratios calculated within the last three seconds). In a particular embodiment, long-term histogram maintenance modules may store every power ratio calculated by a processor. With reference to FIG. 1, short-term histogram maintenance modules may store power ratios from a particular time (e.g., three seconds prior to the first time) to the first time. In a particular embodiment, the particular time is selectable by a processor. Thus, short-term histogram maintenance modules may store more recent power ratios, enabling faster calibration during changing environments. Long-term histogram maintenance modules may store power ratios calculated over an extended period of time which may reduce the effect of improper gain calibrations due to sporadic irregularities during power ratio calculations.

In a particular embodiment, the first gain calibration value 742 and the $(N-1)^{th}$ gain calibration value 744 may be provided to the first time-domain smoothing module 712 and the $(N-1)^{th}$ time-domain smoothing module 714, respectively. The time-domain smoothing modules 712, 714 may smooth the gain calibration values 742, 744 to generate modified calibration values 742', 744'. The modified calibration values 742', 744' may be provided to gain adjustment circuits associated with the second and $N^{th}$ microphones 504, 506, respectively.

Figure 8:
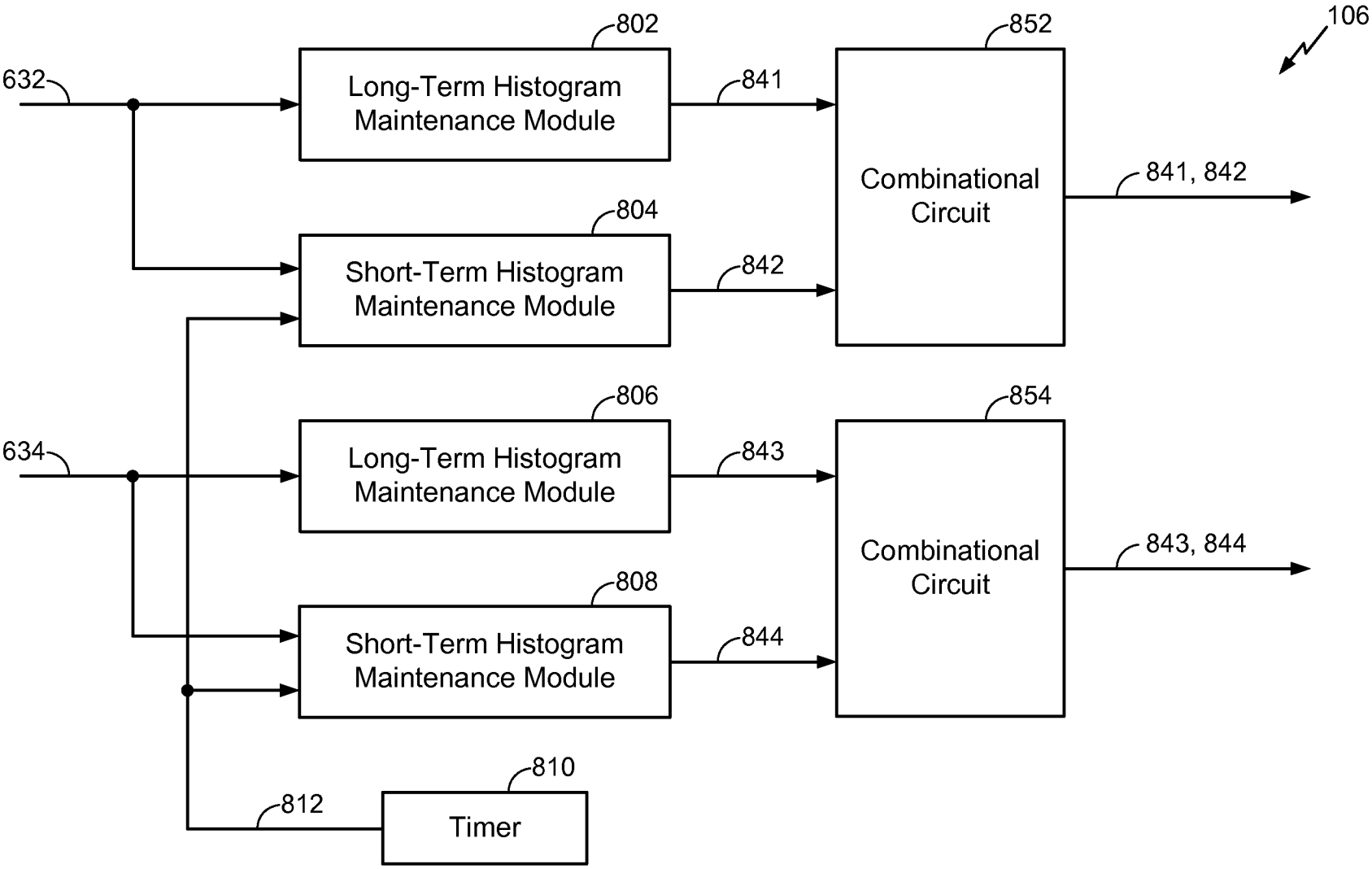
FIG. 8 is a block diagram of another particular illustrative embodiment of a histogram based estimator.

Referring to FIG. 8, another particular illustrative embodiment of the histogram based estimator 106 is shown. The histogram based estimator 106 of FIG. 8 includes a first long-term histogram maintenance module 802, an $(N-1)^{th}$ long-term histogram maintenance module 804, a first short-term histogram maintenance module 806, an $(N-1)^{th}$ short-term histogram maintenance module 808, a timer 810, a first combinational circuit 852, and a second combinational circuit 854.

The histogram maintenance modules 802-808 may operate in substantially similar manner as the histogram maintenance modules 702, 704 of FIG. 7. However, the short-term histogram maintenance modules 804, 808 may maintain corresponding short-term histograms, and the long-term histogram maintenance modules 802, 806 may maintain corresponding long-term histograms.

For example, the short-term histogram maintenance modules 804, 808 may be responsive to the timer 810 in such a manner to only maintain power ratio histograms for a particular time period. For example, the timer 810 may generate a timing signal 812 indicating a relatively short time period (e.g., three seconds). The short-term histogram maintenance modules 804, 808 may maintain power ratios information in the corresponding short-term histograms for the relatively short time (e.g., for up to three seconds prior to the present time). The short-term histogram maintenance modules 802, 804 may generate gain calibration values 842, 844, respectively, based on a power ratio that appears most frequently within the corresponding short-term histograms.

The long-term histogram maintenance modules 802, 806 may maintain the corresponding long-term histograms for a longer period of time. For example, the long-term histograms may be maintained perpetually or from startup to shutdown of a device for which gain matching is being performed.

The gain calibration values 841, 843 (e.g., calibration estimates) associated with the long-term histogram maintenance modules 802, 806 may be expressed as gr. The gain calibration values 842, 844 (e.g., calibration estimates) associated with the short-term histogram maintenance modules 804, 808 may be expressed as $g_S$. The first combinational circuit 852 may determine whether to use a first short-term calibration estimate $g_S$ of the first short-term histogram maintenance module 804 or a first long-term calibration estimate $g_L$ for gain matching. In a particular embodiment, the first short-term calibration estimate $g_S$ may be used if it is considered to be reliable. For example, first combinational circuit 852 may compare an absolute value of a difference between the first short-term calibration estimate $g_S$ and the first long-term calibration estimate $g_L$ (e.g., $|g_L-g_S|$) to a threshold $\beta$. If the absolute value is less than the threshold $\beta$, the first short-term calibration estimate $g_S$ may be considered to be reliable, and the first combinational circuit 852 may provide the first short-term calibration estimate 842 ($g_S$) to a gain calibration circuit associated with the second microphone 502. Otherwise, the first combinational circuit 852 may provide the first long-term calibration estimate 841 ($g_L$) to the gain calibration circuit associated with the second microphone 502. The pseudo code for the first combinational circuit 852 may be represented as:

if $(|g_L-g_S|<\beta)$ $c_t=\alpha*c_{t-1}+(1-\alpha)*g_S$, else $c_t=\alpha*c_{t-1}+(1-\alpha)*g_L$.

Where $\alpha$ is a smoothing parameter less than one, $c_t$ is the output calibration for the second microphone 504 (e.g., target microphone) at a present time (t), $c_{t-1}$ is the output calibration for the second microphone 504 at a previous time instant (t−1).

The second combinational circuit 854 may operate in a substantially similar as the first combinational circuit 852 with respect to signals received from the $N^{th}$ long-term histogram maintenance module 806 and the $N^{th}$ short-term histogram maintenance module 808. For example, second combinational circuit 854 may compare an absolute value of a difference between a second short-term calibration estimate $g_S$ from the $N^{th}$ short-term histogram maintenance module 808 and a second long-term calibration estimate $g_L$ from the $N^{th}$ long-term histogram maintenance module 806 (e.g., $|g_L-g_S|$) to the threshold $\beta$. If the absolute value is less than the threshold $\beta$, the second combinational circuit 854 may provide the second short-term calibration estimate 844 ($g_S$) to a gain calibration circuit associated with the $N^{th}$ microphone 504. Otherwise, the second combinational circuit 854 may provide the second long-term calibration estimate 843 ($g_L$) to the gain calibration circuit associated with the $N^{th}$ microphone 502.

Figure 10:
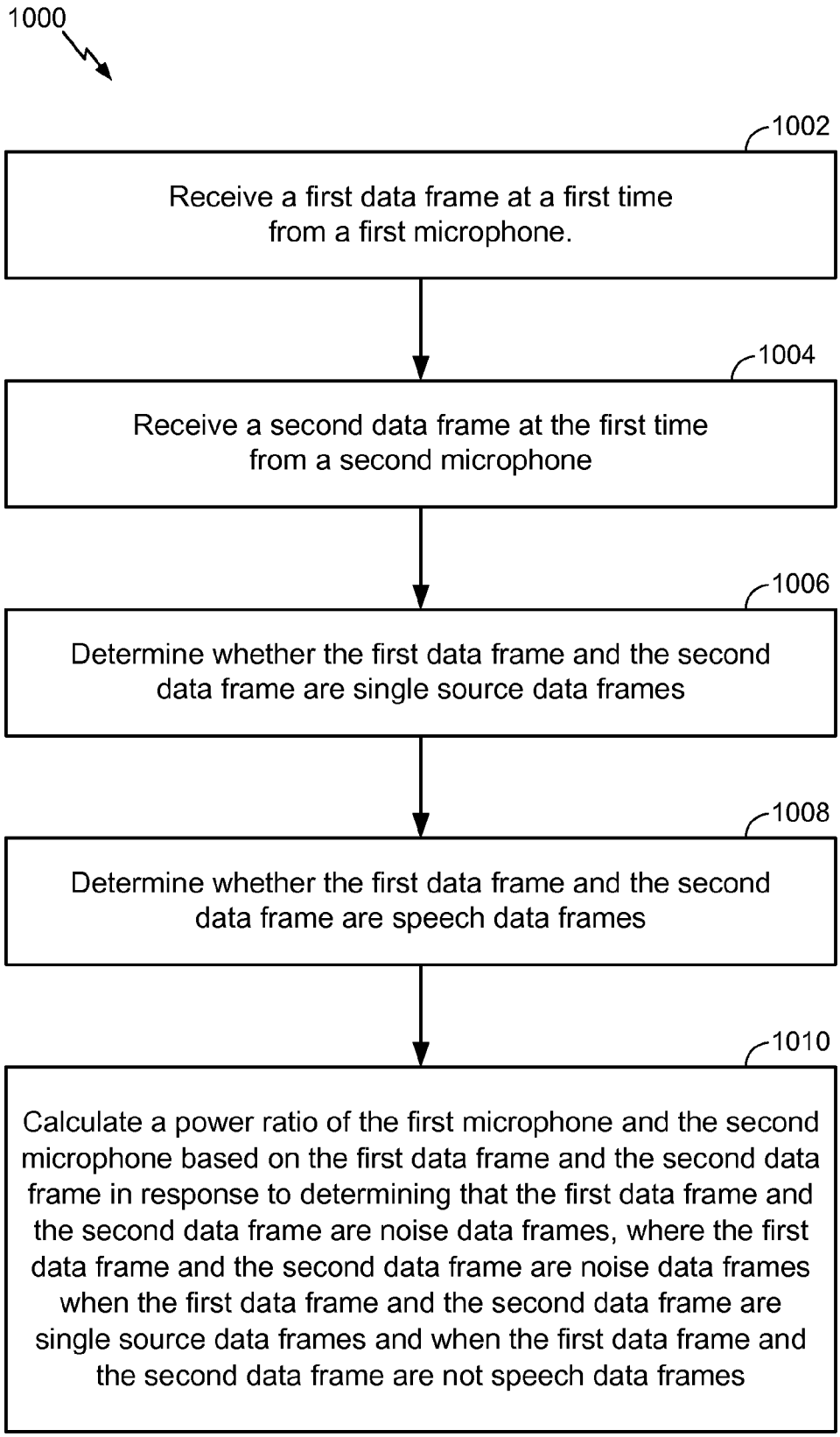
FIG. 10 is a flowchart of a particular embodiment of a method of determining a gain calibration value for a target microphone.

Referring to FIG. 10, a flowchart of a particular embodiment of a method 1000 of determining a gain calibration value for a target microphone is shown. In an illustrative embodiment, the method 1000 may be performed using the system 100 of FIG. 1, the embodiment of the noise detector 102 in FIG. 2, the embodiment of the noise detector 102 in FIG. 4, the system 5 of FIG. 5-7, the embodiment of the power ratio calculator 104 in FIG. 6, the embodiment of the histogram based estimator 106 in FIG. 7, the embodiment of the histogram based estimator 106 in FIG. 8, or any combination thereof.

The method 1000 includes receiving a first data frame at a first time from a first microphone, at 1002. For example, in FIG. 1, the noise detector 102 and the power ratio calculator 104 may receive the first data frame 112 from the first microphone (e.g., the first microphone 502 of FIG. 5). A second data frame may be received at the first time from a second microphone, at 1004. For example, in FIG. 1, the noise detector 102 and the power ratio calculator 104 may also receive the second data frame 114 from the second microphone (e.g., the second microphone 504 of FIG. 5).

The method 1000 may also include determining whether the first data frame and the second data frame are single source data frames, at 1006. For example, in FIG. 2, the SSI module 202 may determine whether the first data frame 112 and the second data frame 114 are single source data frames. The first data frame 112 and the second data frame 114 may be provided to the SSI module 202. The SSI module 202 may detect the data frames where one source (e.g., one type of audio data) is present. The type of audio data may be noise n(t) or speech s(t).

The method 1000 may also include determining whether the first data frame and the second data frame are speech data frames, at 1008. For example, in FIG. 2, the SC-SD module 204 may detect whether the first data frame 112 is a speech data frame and may detect whether the second data frame 114 is a speech data frame. To illustrate, for the first data frame 112 (e.g., $x_1(t)=s(t)+n(t)$), the SC-SD module 204 may determine whether a substantial amount of audio data corresponding to speech s(t) is present or whether a substantial amount of audio data corresponding to speech s(t) is absent. The SC-SD module 204 may make a similar determination for the second data frame 114.

A power ratio of the first microphone and the second microphone may be calculated based on the first data frame and the second data frame in response to determining that the first data frame and the second data frame are noise data frames, at 1010. For example, in FIG. 6, the first frame power calculator module 602 may receive the first data frame 112 and calculate the first frame power of the first data frame 112. The second frame power calculator module 604 may receive the second data frame 114 and calculate the second frame power of the second data frame 114. The first ratio calculator module 612 may calculate the first ratio 632 of the first frame power and the second frame power (e.g., calculate a power ratio for the second microphone 504 based on the first microphone 502 (e.g., the reference microphone)). The first data frame 112 and the second data frame 114 may be classified as noise data frames when both data frames 112, 114 are determined to be single source data frames and when both data frames 112, 114 are determined not to be speech data frames.

In a particular embodiment, the method 1000 may include determining a gain calibration value based on the power ratio. For example, the first ratio 832 generated by the first ratio calculator module 812 may be provided to a gain calibration circuit associated with the second microphone (e.g., the second microphone 504 of FIG. 5) to adjust a power level of the second microphone based on a reference microphone. As another example, in FIG. 7, the first histogram maintenance module 702 may determine the first gain calibration value 742 based on the power ratio that appears most frequency in the histogram corresponding to the first ratio 632. In response, the first histogram maintenance module 702 may generate the first gain calibration value 942, and the first gain calibration value 742 may be provided to the gain calibration circuit associated with the second microphone 504. As another example, in FIG. 8, the first combinational circuit 852 may determine whether the first short-term calibration estimate $g_S$ of the first short-term histogram maintenance module 804 is reliable. If the first short-term calibration estimate $g_S$ is reliable, the first combinational circuit 852 may provide the first short-term calibration estimate 842 ($g_S$) to the gain calibration circuit associated with the second microphone 502. Otherwise, the first combinational circuit 852 may provide the first long-term calibration estimate 841 ($g_L$) to the gain calibration circuit associated with the second microphone 502.

Figure 11:
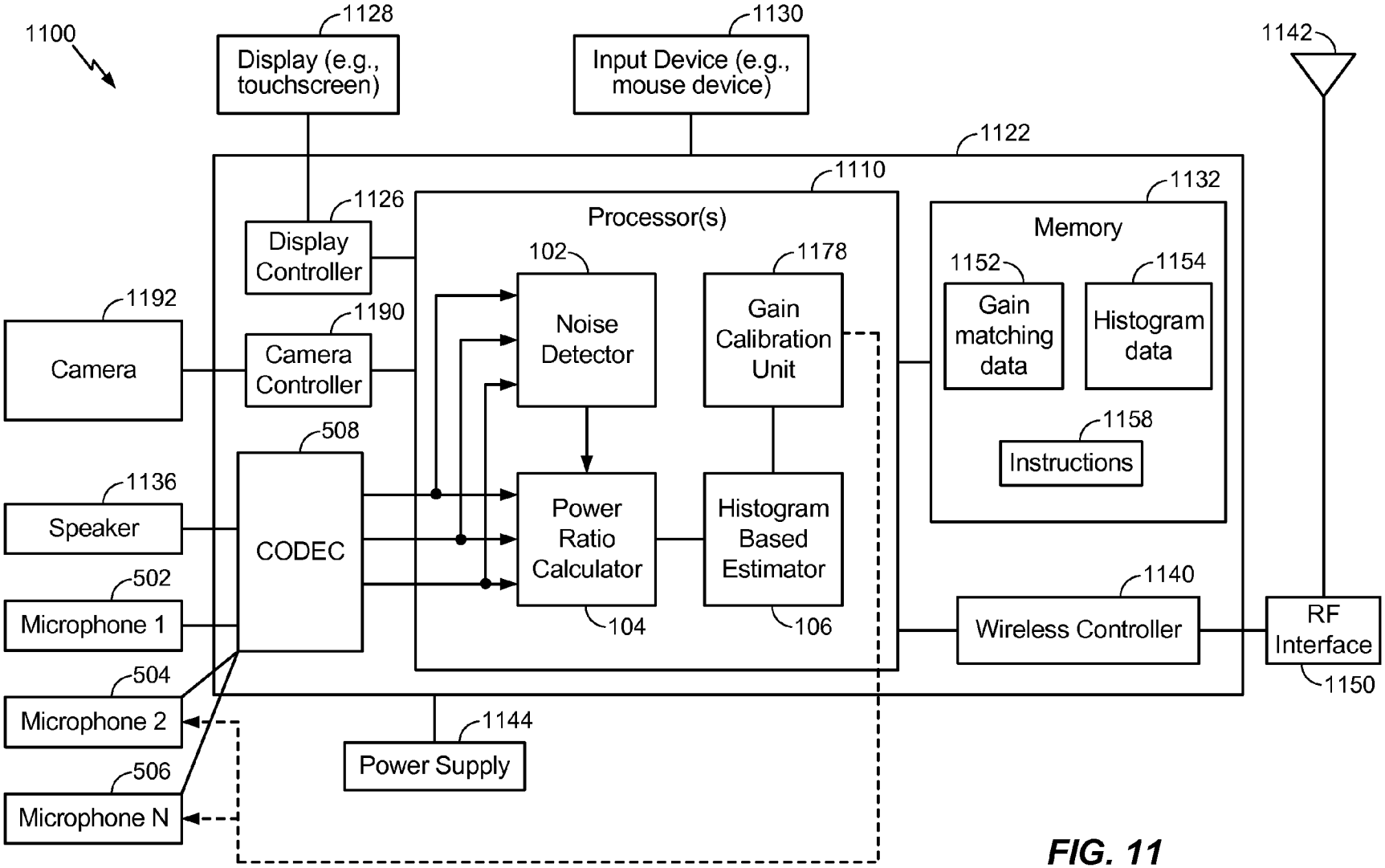
FIG. 11 is a block diagram of a wireless device including components operable to determine a gain calibration value for a target microphone.

Referring to FIG. 11, a block diagram of wireless device 1100 including components operable to determine a gain calibration value for a target microphone is shown. The device 1100 includes a processor 1110, such as a digital signal processor (DSP), coupled to a memory 1132.

FIG. 11 also shows a display controller 1126 that is coupled to the processor 1110 and to a display 1128. A camera controller 1190 may be coupled to the processor 1110 and to a camera 1192. A speaker 1136, the first microphone 502, the second microphone 504, and the $N^{th}$ microphone 508 may be coupled to the CODEC 508. The CODEC 508 may provide the data frames 112-116 to the processor 1110 in response to receiving audio signals from the respective microphones 502-506. For example, the processor 1110 may include the noise detector 102, the power ratio calculator 104, and the histogram based estimator 106. In another example, the noise detector 102, the power ratio calculator 104, and the histogram based estimator 106 may be stored in the memory 1132 as instructions 1158 that are executable by the processor 1110 to perform the functions of the noise detector 102, the power ratio calculator 104, and the histogram based estimator 106. The CODEC 508 may provide the data frames 112-116 to the noise detector 102 and the power ratio calculator 104 as described with respect to FIG. 1.

The memory 1132 may include histogram data 1154 and gain matching data 1152. In a particular embodiment, the histogram data 1154 may correspond to the histogram of power ratios illustrated in FIG. 11. The histogram based estimator 106 may access the histogram data 1154 from the memory 1122 in response to receiving a power ratio from the power ratio calculator. The histogram data 1154 may be used to determine a power ratio that has occurred most frequently in the histogram data 1154 in the manner described with respect to FIGS. 9-10. In response to determining the power ratio that has occurred most frequently, the histogram based estimator 106 may access the gain matching data 1152 from the memory 1122 to determine a corresponding calibration value. The histogram based estimator 106 may provide the calibration value to a gain calibration circuit 1178 associated with the corresponding target microphone (e.g., the second microphone 504 and/or the $N^{th}$ microphone 506) to adjust the gain based on the reference microphone (e.g., the first microphone 502).

The memory 1132 may be a tangible non-transitory processor-readable storage medium that includes the instructions 1158. The instructions 1156 may be executed by a processor, such as the processor 1110 or the components thereof, to perform the method 1000 of FIG. 10. FIG. 11 also indicates that a wireless controller 1140 can be coupled to the processor 1110 and to a wireless antenna 1142 via a radio frequency (RF) interface 1180. In a particular embodiment, the processor 1110, the display controller 1126, the memory 1132, the CODEC 508, and the wireless controller 1140 are included in a system-in-package or system-on-chip device 1122. In a particular embodiment, an input device 1130 and a power supply 1144 are coupled to the system-on-chip device 1122. Moreover, in a particular embodiment, as illustrated in FIG. 11, the display 1128, the input device 1130, the speaker 1136, the microphones 502-506, the wireless antenna 1142, and the power supply 1144 are external to the system-on-chip device 1122. However, each of the display 1128, the input device 1130, the speaker 1136, the microphones 502-506, the wireless antenna 1142, and the power supply 1144 can be coupled to a component of the system-on-chip device 1122, such as an interface or a controller.

In conjunction with the described embodiments, an apparatus is disclosed that includes means for receiving a first data frame at a first time from a first microphone. For example, the means for receiving the first data frame may include the noise detector 102 of FIG. 1, power ratio calculator 104 of FIG. 1, the SSI module 202 of FIG. 2, the SC-SD module 204 of FIG. 2, the SSI module 402 of FIG. 4, the SC-SD module 404 of FIG. 4, the first two microphone SSI module 520 of FIG. 5, the $(N-1)^{th}$ two microphone SSI module 522 of FIG. 5, the first SC-SD module 524 of FIG. 5, the first frame power calculator 602 of FIG. 6, the processor 1110 programmed to execute the instructions 1158 of FIG. 11, one or more other devices, circuits, modules, or instructions to receive the first data frame, or any combination thereof.

The apparatus may also include means for receiving a second data frame at the first time from a second microphone. For example, the means for receiving the second data frame may include the noise detector 102 of FIG. 1, power ratio calculator 104 of FIG. 1, the SSI module 202 of FIG. 2, the SC-SD module 204 of FIG. 2, the SSI module 402 of FIG. 4, the SC-SD module 404 of FIG. 4, the first two microphone SSI module 520 of FIG. 5, the second SC-SD module 526 of FIG. 5, the second frame power calculator 604 of FIG. 6, the processor 1110 programmed to execute the instructions 1158 of FIG. 11, one or more other devices, circuits, modules, or instructions to receive the second data frame, or any combination thereof.

The apparatus may also include means for calculating a power ratio of the first microphone and the second microphone based on the first data frame and the second data frame. For example, the means for calculating the power ratio may include the system 100 of FIG. 1, the embodiment of the noise detector 102 in FIG. 2, the embodiment of the noise detector 102 in FIG. 4, the system 5 of FIG. 5, the embodiment of the power ratio calculator 104 in FIG. 6, the embodiment of the histogram based estimator 106 in FIG. 7, the embodiment of the histogram based estimator 106 in FIG. 8, the processor 1110 programmed to execute the instructions 1158 of FIG. 11, the gain matching data 1152 of FIG. 11, the histogram data 1154 of FIG. 11, one or more other devices, circuits, modules, or instructions to calculate the power ratio, or any combination thereof.

Those of skill would further appreciate that the various illustrative logical blocks, configurations, modules, circuits, and algorithm steps described in connection with the embodiments disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A method comprising:

receiving, at a processor, a first data frame from a first microphone;

receiving, at the processor, a second data frame from a second microphone;

determining whether the first data frame and the second data frame are single source data frames;

determining whether the first data frame and the second data frame are noise data frames in response to a determination that the first data frame and the second data frame are single source data frames;

calculating a power ratio of the first microphone and the second microphone based on the first data frame and the second data frame in response to determining that the first data frame and the second data frame are noise data frames; and determining a gain calibration value based on a comparison of first power ratios calculated by the processor during a first time period and second power ratios calculated by the processor during a second time period, wherein the first time period is longer than the second time period.

2. The method of claim 1, further comprising discontinuing gain calibration processing with respect to the first data frame and the second data frame in response to determining that at least one of the first data frame or the second data frame is not a single source data frame.

3. The method of claim 1, wherein the single source data frame includes data representing speech having a speech amplitude or data representing noise having a noise amplitude.

4. The method of claim 1, further comprising:

determining whether the first data frame is a speech data frame in response to a determination that the first data frame is a single source data frame; and determining whether the second data frame is a speech data frame in response to a determination that the second data frame is a single source data frame.

5. The method of claim 4, wherein a determination that the first data frame is not a speech data frame indicates that the first data frame is a noise data frame, and wherein a determination that the second data frame is not a speech data frame indicates that the second data frame is a noise data frame.

6. The method of claim 1, wherein the second time period is within the first time period.

7. The method of claim 1, further comprising:

determining a first histogram of the first power ratios and a second histogram of the second power ratios; and wherein the gain calibration value is determined based on the first histogram or the second histogram.

8. The method of claim 7, wherein the gain calibration value corresponds to a particular power ratio that has a highest count in the first histogram or in the second histogram.

9. The method of claim 7, wherein the first histogram comprises a long-term histogram of the first power ratios and the second histogram rises a short-term histogram of the second power ratios, wherein the long-term histogram corresponds to the first time period, and the short-term histogram corresponds to the second time period.

10. The method of claim 9, wherein a first length of the first time period and a second length the second time period are adjustable via the processor.

11. The method of claim 1, further comprising:

determining a long-term histogram of the first power ratios;

determining a short-term histogram of the second power ratios; and wherein determining the gain calibration value is based on a comparison of the long-term histogram and the short-term histogram.

12. The method of claim 1, further comprising discontinuing gain calibration processing with respect to the first data frame and the second data frame in response to determining that the first data frame is not a noise data frame or that the second data frame is not a noise data frame.

13. The method of claim 1, further comprising:

receiving a third data frame from a third microphone; and calculating a power ratio of the first microphone and the third microphone based on the first data frame and the third data frame in response to determining that the first data frame and the third data frame are noise data frames.

14. An apparatus comprising:

a processor; and a memory accessible to the processor, the memory storing instructions that are executable by the processor to cause the processor to:

receive a first data frame from a first microphone;

receive a second data frame from a second microphone;

determine whether the first data frame and the second data frame are single source data;

determine whether the first data frame and the second data frame are noise data frames in response to a determination that the first data frame and the second data frame are single source data frames;

calculate a power ratio of the first microphone and the second microphone based on the first data frame and the second data frame in response to determining that the first data frame and the second data frame are noise data frames; and determine a gain calibration value based on a comparison of first power ratios calculated by the processor during a first time period and of second power ratios calculated by the processor during a second time period, wherein the first time period is longer than the second time period.

15. The apparatus of claim 14, wherein the instructions are further executable by the processor to cause the processor to discontinue gain calibration processing with respect to the first data frame and the second data frame in response to determining that at least one of the first data frame or second data frame is not a single source data frame.

16. The apparatus of claim 14, wherein the single source data frame includes data representing speech having a speech amplitude or data representing noise having a noise amplitude.

17. The apparatus of claim 14, wherein the instructions are further executable by the processor to cause the processor to:

determine whether the first data frame is a speech data frame in response to a determination that the first data frame is a single source data frame; and determine whether the second data frame is a speech data frame in response to a determination that the second data frame is a single source data frame.

18. The apparatus of claim 17, wherein a determination that the first data frame is not a speech data frame indicates that the first data frame is a noise data frame, and wherein a determination that the second data frame is not a speech data frame indicates that the second data frame is a noise data frame.

19. The apparatus of claim 14, wherein the second time period is within the first time period.

20. An apparatus comprising:

means for receiving a first data frame from a first microphone;

means for receiving a second data frame from a second microphone;

means for determining whether the first data frame and the second data frame are single source data frames;

means for determining whether the first data frame and the second data frame are noise data frames in response to a determination that the first data frame and the second data frame are single source data frames;

means for calculating a power ratio of the first microphone and the second microphone based on the first data frame and the second data frame in response to determining that the first data frame and the second data frame are noise data frames; and means for determining a gain calibration value based on a comparison of first power ratios calculated during a first time period and of second power ratios calculated during a second time period, wherein the first time period is longer than the second time period.

21. The apparatus of claim 20, wherein the means for determining whether the first data frame and the second data frame are single source data frames includes a single-source identifier module executable by a processor.

22. The apparatus of claim 20, wherein the means for determining whether the first data frame and the second data frame are noise data frames includes a single channel signal detector module executable by a processor.

23. The apparatus of claim 20, wherein the means for calculating includes a power ratio calculator executable by a processor.

24. The apparatus of claim 20, wherein the single source data frame includes a substantial amount of speech or a substantial amount of noise.

25. The apparatus of claim 20, wherein the means for determining the gain calibration value includes a combination module executable by a processor.

26. A non-transitory computer-readable storage medium comprising instructions that, when executed by a processor, cause the processor to:

receive a first data frame from a first microphone;

receive a second data frame from a second microphone;

determine whether the first data frame and the second data frame are single source data frames;

determine whether the first data frame and the second data frame are noise data frames in response to a determination that the first data frame and the second data frame are single source data frames;

calculate a power ratio of the first microphone and the second microphone based on the first data frame and the second data frame in response to determining that the first data frame and the second data frame are noise data frames; and determine a gain calibration value based on a comparison of first power ratios calculated by the processor during a first time period and second power ratios calculated by the processor during a second time period, wherein the first time period is longer than the second time period.

27. The non-transitory computer-readable storage medium of claim 26, further comprising instructions that, when executed by the processor, cause the processor to discontinue gain calibration processing with respect to the first data frame and the second data frame in response to determining that at least one of the first data frame or second data frame is not a single source data frame.

28. The non-transitory computer-readable storage medium of claim 26, further comprising instructions that, when executed by the processor, cause the processor to:

determine whether the first data frame is a speech data frame in response to a determination that the first data frame is a single source data frame; and determine whether the second data frame is a speech data frame in response to a determination that the second data frame is a single source data frame.

29. The non-transitory computer-readable storage medium of claim 28, wherein a determination that the first data frame is not a speech data frame indicates that the first data frame is a noise data frame, and wherein the second data frame is a noise data frame in response to a determination that the second data frame is not a speech data frame indicates that the second data frame is a noise data frame.

30. The non-transitory computer-readable storage medium of claim 26, further comprising instructions that, when executed by the processor, cause the processor to:

determine a long-term histogram of the first power ratios based on the calculated first power ratios by the processor during the first time period; and determine a short-term histogram of the second power ratios based on the calculated second power ratios by the processor during the second time period.

* * * * *